United States Patent [19]

Breuker et al.

[11] Patent Number: 4,755,277

[45] Date of Patent: Jul. 5, 1988

[54] PROCESS FOR THE PREPARATION OF A HYDROCARBONACEOUS DISTILLATE AND A RESIDUE

[75] Inventors: Jacobus H. Breuker; Gerrit van Gooswilligen; Johannes L. M. Syrier, all of Amsterdam, Netherlands

[73] Assignee: Shell Oil Company, Houston, Tex.

[21] Appl. No.: 28,520

[22] Filed: Mar. 20, 1987

[30] Foreign Application Priority Data

Apr. 4, 1986 [GB] United Kingdom ..... 8608301

[51] Int. Cl.[4] ..... C10C 1/00; C10L 1/00

[52] U.S. Cl. ..... 208/40; 208/14; 208/41; 208/347; 208/348; 208/23; 106/273 R; 106/278

[58] Field of Search ..... 208/41, 347, 348, 14; 106/273 R, 278

[56] References Cited

U.S. PATENT DOCUMENTS

| | | | |
|---|---|---|---|
| 1,413,260 | 4/1922 | Clark | 208/41 |
| 1,905,156 | 4/1933 | Coubrough | 208/41 |
| 1,997,675 | 4/1935 | Bahlke et al. | 208/41 |
| 2,030,281 | 2/1936 | Coubrough | 208/41 |
| 2,067,264 | 1/1937 | Ebberts | 208/41 |
| 2,125,325 | 4/1938 | Youker | 208/41 |
| 2,224,685 | 12/1940 | Kahl | 208/41 |
| 2,687,989 | 8/1954 | Goodwin | 106/273 R |
| 2,691,621 | 10/1954 | Gagle | 106/273 R |
| 3,372,045 | 3/1968 | Baum | 208/41 |
| 4,096,056 | 6/1978 | Haywood et al. | 208/4 |
| 4,139,397 | 2/1979 | Yan | 106/273 R |
| 4,437,896 | 3/1984 | Partanen | 106/273 R |
| 4,495,060 | 1/1985 | Abrams et al. | 208/48 |
| 4,617,062 | 10/1986 | Poirer | 106/273 R |
| 4,631,088 | 12/1986 | Poirer | 106/273 R |

FOREIGN PATENT DOCUMENTS

| | | | |
|---|---|---|---|
| 828042 | 11/1969 | Canada | 106/273 |
| 2286185 | 4/1976 | France | 106/273 R |

*Primary Examiner*—Helen M. S. Sneed
*Assistant Examiner*—Helane Myers

[57] ABSTRACT

A process is disclosed for the preparation of a hydrocarbonaceous distillate and a hydrocarbonaceous residue, which comprises mixing a residual fraction of a product obtained by catalytic cracking or hydrocracking a hydrocarbonaceous feedstock, with a second hydrocarbonaceous fraction having such a boiling range that at least 50% w boils at a temperature above 400° C., and subjecting the resulting mixture to a subatmospheric distillation yielding at least one distillate fraction and one residue. The residue thus prepared is a suitable component in bitumen compositions.

7 Claims, No Drawings

PROCESS FOR THE PREPARATION OF A HYDROCARBONACEOUS DISTILLATE AND A RESIDUE

FIELD OF THE INVENTION

The present invention relates to a process for the preparation of a hydrocarbonaceous distillate and a hydrocarbonaceous residue from a residual fraction of a product obtained by catalytic cracking or hydrocracking a hydrocarbonaceous feedstock.

BACKGROUND OF THE INVENTION

In the refining of crude oil cracking is a widely used operation. Cracking is a method to obtain lighter products from a relatively heavy feedstock. Cracking operations include thermal cracking, catalytic cracking and hydrocracking. After the cracking operation the cracked products are separated, generally by distillation, in at least one distillate fraction and a residual fraction. This latter fraction is frequently used as a fuel oil component.

This residual fraction, however, contains several relatively light hydrocarbons which have a higher intrinsic value than just that of a fuel oil component. This is especially the case in residual fractions obtained after hydrocracking and catalytic cracking operations. These relatively light hydrocarbons are the main reason why these residual fractions are unfit for use in bitumen compositions. So, it would appear that separation of these relatively light hydrocarbons would be beneficial since then not only relatively valuable hydrocarbons would be obtained, but also a fraction suitable for use as bitumen component.

Separation of these relatively light hydrocarbons from the residual fraction by vacuum distillation appears to be troublesome, since fouling and plugging problems may arise. These problems are due to the fact that at the desired distillation conditions a big proportion of the residual fraction evaporates thereby entraining heavier products. The latter products not only cause a relatively bad separation but may also cause plugging problems in discharge conduits at the top of the distillation column. The bottom fraction of the distillation may give rise to troubles, too, since fine particles of the catalyst, applied to catalytic and/or hydrocracking, which are present in the residual fraction, are concentrated in the bottom fraction of the vacuum distillation, which tends to be rather viscous, and causes fouling of the conduit system for removing this bottom fraction. The present invention provides a solution to these problems.

SUMMARY OF THE INVENTION

This invention relates to a process for the preparation of a hydrocarbonaceous distillate and a hydrocarbonaceous residue, which comprises mixing a residual fraction of a product obtained by catalytic cracking or hydrocracking a hydrocarbonaceous feedstock, with a second hydrocarbonaceous fraction having such a boiling range that at least 50%w boils at a temperature above 400° C., and subjecting the resulting mixture to a subatmospheric distillation, yielding at least one distillate fraction and one residue.

DESCRIPTION OF THE PREFERRED EMBODIMENTS

Due to the fact that the residual fraction is mixed with a second fraction, the relative amount of the mixture which is distilled, is reduced thereby avoiding entrainment problems, whereas the relatively increased amount of the bottom fraction insures that the fine catalyst particles are well dispersed at a lower concentration so that fouling of the conduit system no longer occurs.

It appears that the residue obtained shows very good properties as bitumen component.

The problems referred to above are more prominent in the handling of the product obtained by catalytic cracking than by hydrocracking. The process according to the present invention therefore finds suitable application in the handling of a residual fraction originating from catalytic cracking of a hydrocarbonaceous feedstock.

The residual fraction which is subjected to the process according to the invention is generally obtained as the bottom fraction in the (atmospheric) distillation of the cracked product. The conditions under which the (atmospheric) distillation is carried out may vary so that the bottom fraction may vary in boiling characteristics. Moreover, not the entire bottom fraction needs to be subjected to the present process. Suitably, the residual fraction which is subjected to the present process has an initial boiling point of at least 200° C.

The second hydrocarbonaceous fraction must fulfill some requirements regarding its boiling range. These requirements insure that the part of it which is distilled in the subatmospheric distillation, is not too big. Therefore, it must have such a boiling range that at least 50%w boils above 400° C. Preferably, its boiling range is such that over 60%w boils at a temperature above 460° C.

The second fraction can be selected from a wide range of heavy hydrocarbons, such as a long residue, short residue, a thermally cracked residue, a solvent extract of a lubricating oil fraction, in particular, the furfural, phenol or methyl pyrrolidone extract or the extract of sulfur dioxide or a sulfur dioxide/benzene mixture, a deasphalted oil or a bitumen obtained after deasphalting. The deasphalting may be carried out by lower alkanes, in particular $C_3$–$C_8$ alkanes, such as propane, butanes or pentanes.

The ratio in which the two residual fractions are mixed, depends to a great extent on their boiling characteristics and the conditions under which the subatmospheric distillation is carried out.

In the resulting mixture, the weight ratio between the second fraction and the residual fraction of the product obtained by cracking a hydrocarbonaceous feedstock preferably varies between 1:9 and 9:1.

The subatmospheric distillation is preferably carried out at a temperature corresponding with the boiling point at the subatmospheric pressure of a hydrocarbon having an atmospheric boiling point of at least 400° C. (400° C./bar hydrocarbons). In particular, the temperature is preferably above the boiling point of 460° C./bar hydrocarbons. By using these conditions, the residue has a sufficiently reduced volatility to meet standards regarding its suitability as bitumen component. The distillation temperature is suitably in a range corresponding to the boiling point of hydrocarbons having an atmospheric boiling point in the range from 460° C.

to 550° C. This insures a suitable volatility of the residue.

The reference to the hydrocarbon boiling point at atmospheric pressure (1 bar) is made after conversion of a subatmospheric boiling point in accordance with the Maxwell-Bonnell relation which is described in Ind. Eng. Chem., 49 (1957) 1187–1196. In practice, a boiling point of such hydrocarbons is determined at subatmospheric pressure. Since at many subatmospheric pressures many different boiling points can be determined, the person skilled in the art prefers to refer to an unambiguous atmospheric boiling point.

The subatmospheric distillation may be a conventional vacuum distillation. Preferably, it is a subatmospheric flash distillation. This implies that the mixture of the two residual fractions is heated to a temperature in the boiling range of the liquid at a lower pressure, and introduced into a subatmospheric flash zone to yield distillate and residue.

Many subatmospheric pressures may be used in the distillation according to the invention. Each pressure applied determines the temperature limits within which the distillation suitably is carried out. Preferably, the actual temperature in the distillation does not exceed 400° C.

Below this temperature, reactions between or of the hydrocarbons in the mixture such as, for example, cracking reactions, are substantially excluded. Since at relatively long residence times cracking reactions can take place at high temperatures up to 400° C., it is even more preferred to have somewhat lower actual distillation temperatures, in particular between 310° C. and 370° C. The pressure in the subatmospheric distillation is preferably between 2 mm Hg and 120 mm Hg (0.27 and 16.0 kPa).

The process according to the invention is preferably carried out such that 20–80%w of the resulting mixture is recovered as distillate(s) and the remainder as residue. This can be achieved by selecting the mixing ratio of both residual fractions properly and by choosing suitable conditions of the subatmospheric distillation. The mixing ratio is not only determined by the boiling characteristics of the fractions, but also by their viscosities. When the second fraction is low in volatility and it further does not substantially increase the viscosity of the bottom product (residue) of the subatmospheric distillation, a relatively low content thereof is required in the present process. Such situations can especially arise when as second hydrocarbonaceous residual fraction a solvent extract of a lubricating oil fraction is used.

The present invention also relates to a bitumen composition comprising a hydrocarbonaceous residue prepared as described hereinbefore. This bitumen composition shows good overall properties and in particular good adhesion. The oxidation stability, though satisfactory, can be increased by subjecting the hydrocarbonaceous residue to a blowing step. This can be done either before or after mixing the residue with other bituminous components. The blowing process is suitably carried our continuously in a blowing column, into which a liquid bitumen component is fed and wherein the level of the liquid is kept approximately constant by withdrawing bitumen. Air is blown through the liquid from a distributor near the bottom. Suitably, the blowing step is carried out at a temperature of 170° C. to 320° C. The temperature is preferably from 220° C. to 275° C.

The bitumen composition according to the invention may comprise solely the residue prepared according to the invention. However, it is known in the art to blend many types of bituminous components to acquire a mixture with the desired properties. The composition according to the invention may therefore also contain other bituminous constituents. Preferably, it contains from 50%w to 99%w of a hydrocarbonaceous residue prepared in the present process.

In the process according to the present invention, as second fraction, preferably a solvent extract of a lubricating oil fraction is used, since the hydrocarbonaceous residue thus obtained is a very suitable bitumen component. Not only has it the properties depicted above, but it also appears to be very well pigmentable, showing a satisfactory color at a relatively low concentration of a pigment e.g. 1.0–2%w, based on the total asphaltic composition. Suitable pigments include red and yellow iron oxide, titanium oxid, chromex green, cobalt blue etc.

The ultimate asphalt compositions when used as road tracks, usually contain mineral aggregates and fillers, each in proportions of about 5–98%w, preferably 20–95%w, based on the asphalt composition. Suitable mineral aggregates are stone chips, gravel, slate and sand. As filler, dusts, ground chalk, grund limestone, talc and the like may be employed.

To the bitumen composition according to the invention, additives may be added such as natural or synthetic rubbers, e.g. optionally, hydrogenated, linear or branched (star-shaped) block, tapered or random copolymers of styrene and a conjugated diene (e.g. butadiene or isoprene); waxes, such as paraffin waxes; polymers such as polyethene, polypropene, poly(iso)butene; tackifiers such as lithium salts of $C_{10-40}$ fatty acids of hydroxy fatty acids, e.g. lithium hydroxy stearate, etc.

This invention will be illustrated by means of the following examples which are not intended to be construed as limiting the invention.

EXAMPLE I

In this Example an atmospheric residue obtained from a catalytically cracked product having 50%w boiling below 450° C. and 76%w below 500° C. and a catalyst fines content of 0.2%w, was subjected in a laboratory-scale vacuum flash distillation column at a rate of 0.6 kg/hr and at a temperature of 365° C. and a pressure 29 mmHg (3.87 kPa), corresponding with the boiling point of 500° C./bar-hydrocarbons. During the flashing experiment a serious fouling and plugging tendency was observed already after a few hours operation. (Distillate yield was 73%w.)

The experiment was repeated with a feed consisting of 85%w and 75%w of a thermally cracked residue from a North Sea crude and 25%w and 15%w of the above catalytically cracked product, respectively. The flashing experiments covered an effective operational period of 60 hours. No fouling or plugging tendency was observed. The respective distillate yields were 25.9%w and 32.7%w.

EXAMPLE II

Some characteristics of bituminous compositions containing a residue obtained after flashing a mixture of a catalytically cracked residue and a thermally cracked residue, were determined. The flashing conditions corresponded with the boiling point of 470° C./bar hydrocarbons. In a thin film oven test (TFOT) according to ASTM D1754 the compositions were subjected to heat and air, and their aging behavior was determined. After the test the penetration was measured and compared with the original penetration, yielding a retained-penetration value (in %). The higher the retained-penetration value, the better the composition is able to stand up against heat and air. The loss of weight during the test was determined a well; and also the change in the softening point, determined by the Ring and Ball method, was measured (ΔR & B). For comparison purposes the results of a test with a composition which does not contain any catalytically cracked residue is included in Table I.

TABLE

| Feed | A | B | C |
|---|---|---|---|
| Cat. cracked residue, % w | 40 | 20 | 0 |
| Thermally cracked residue, % w | 60 | 80 | 100 |
| Penetration/25° C. dmm | 29 | 45 | 69 |
| Softening point, °C. | 51.5 | 49 | 48 |
| Penetration index | −1.9 | −1.7 | −1.0 |
| TFOT (163° C.) | | | |
| Loss on heating % m/m | 0.04 | 0.02 | 0.1 |
| Retained penetration % | 5.1 | 56 | 54 |
| Δ R & B °C. | 7.5 | 8 | 9 |

From these results, it is apparent that overall properties of compositions A and B are at least similar to those of composition C.

EXAMPLE III

In this Example a bright stock furfural extract (BFE) was used as second fraction. A mixture comprising 25%w BFE and 75%w catalytically cracked residue, was subjected to a flashing operation at 365° C., 1.2 kPa, corresponding with the boiling point of 540° C./bar-hydrocarbons. The residue (22%w) showed a penetration of 21 dmm and a softening point of 56° C.

The residue was blended with a Middle East BFE and some characteristics were determined. The results are indicated in Table II. The blend was excellently pigmentable.

TABLE II

| Feed | D |
|---|---|
| Flashed residue, % w | 81 |
| Middle East BFE, % w | 19 |
| Penetration, dmm | 81 |
| Softening point, °C. | 44 |
| Penetration index | −1.7 |
| TFOT (163° C.) | |
| Loss on heating, % m/m | −0.1 |
| Retained penetration, % | 65 |
| Δ R & B °C. | 8 |

We claim as our invention:

1. A process for the preparation of a hydrocarbon product comprising (1) at least one hydrocarbonaceous distillate and (2) a hydrocarbonaceous residue by the process steps of:

(a) catalytically cracking a hydrocarbonaceous feedstock in the presence of a catalyst to catalytically crack said hydrocarbonaceous feedstock and to produce a cracked product comprising a residual hydrocarbonaceous fraction;

(b) separating said residual hydrocarbonaceous fraction from said cracked product and mixing said recovered residual fraction with a hydrocarbon fraction selected from the group consisting of long residue, short residue, a thermally cracked residue, a solvent extract of lubricating oil fraction, deasphalted oil and deasphalted bitumen, and having a boiling range where at least 50%w of said hydrocarbon fraction has a boiling point above 400° C. to produce a residual fraction and hydrocarbon fraction mixture wherein the weight ratio between said hydrocarbon fraction and said recovered residual fraction in said residual fraction and said hydrocarbon fraction mixture is between 1:9 and 9:1; and (c) distilling said residual fraction and hydrocarbon fraction mixture in a subatmospheric distillation zone at subatmospheric distillation conditions to produce at least one hydrocarbonaceous distillate fraction and at least one hydrocarbonaceous residue.

2. The process of claim 1 wherein said residual hydrocarbonaceous fraction has an initial boiling point of at least 200° C.

3. The process of claim 1 wherein over 60%w of said hydrocarbon fraction has a boiling point of above 460° C.

4. The process of claim 1 wherein the subatmospheric distillation zone distills said residual fraction and hydrocarbon fraction mixture at a temperature corresponding to the boiling point of the subatmospheric pressure of hydrocarbons having an atmospheric boiling point of at least 460° C.

5. The process of claim 1 wherein the subatmospheric distillation zone distills said residual fraction and hydrocarbon fraction mixture in a flash distillation.

6. The process of claim 1 wherein said composition of said residual fraction and hydrocarbon fraction mixture and said subatmospheric distillation conditions are chosen to provide that 20 to 60%w of said distilled mixture is recovered as said at least one hydrocarbonaceous distillate fraction and to provide that from 40 to 80%wof said distilled mixture is recovered as said hydrocarbonaceous residue.

7. A process for preparing a bitumen composition comprising a hydrocarbonaceous residue which is prepared by a process which comprises:

(a) catalytically cracking a hydrocarbonaceous feedstock in the presence of a catalyst to catalytically crack said hydrocarbonaceous feedstock and to produce a cracked product comprising a residual hydrocarbonaceous fraction;

(b) separating said residual hydrocarbonaceous fraction from said cracked product and mixing said recovered residual fraction with a hydrocarbon fraction having a boiling range where at least 50%w of said hydrocarbon fraction has a boiling point above 400° C. to produce a residual fraction and hydrocarbon fraction mixture; and (c) distilling said residual fraction and hydrocarbon fraction mixture in a subatmospheric distillation zone at subatmospheric distillation conditions to produce at least one hydrocarbonaceous distillate fraction and at least one hydrocarbonaceous residue.

* * * * *